US011008637B2

(12) United States Patent
Fujihara

(10) Patent No.: US 11,008,637 B2
(45) Date of Patent: May 18, 2021

(54) METHOD OF PRODUCING MARTENSITIC STAINLESS STEEL STRIP

(71) Applicant: Hitachi Metals, Ltd., Tokyo (JP)

(72) Inventor: Hiroyoshi Fujihara, Tokyo (JP)

(73) Assignee: Hitachi Metals, Ltd., Tokyo (JP)

( * ) Notice: Subject to any disclaimer, the term of this patent is extended or adjusted under 35 U.S.C. 154(b) by 217 days.

(21) Appl. No.: 15/867,695

(22) Filed: Jan. 11, 2018

(65) Prior Publication Data

US 2018/0195145 A1 Jul. 12, 2018

(30) Foreign Application Priority Data

Jan. 12, 2017 (JP) ..... JP2017-003184

(51) Int. Cl.
*C21D 9/52* (2006.01)
*C21D 6/00* (2006.01)
(Continued)

(52) U.S. Cl.
CPC ..... *C21D 9/52* (2013.01); *C21D 1/18* (2013.01); *C21D 1/25* (2013.01); *C21D 1/74* (2013.01);
(Continued)

(58) Field of Classification Search
CPC ... C21D 9/52; C21D 1/18; C21D 1/74; C21D 6/002; C21D 6/005; C21D 6/008;
(Continued)

(56) References Cited

U.S. PATENT DOCUMENTS

2013/0333811 A1 12/2013 Batiste et al.
2014/0147697 A1 5/2014 Berkhout et al.
2017/0145535 A1* 5/2017 Fojer ..... C22C 38/06

FOREIGN PATENT DOCUMENTS

CN 103649347 3/2014
CN 105132820 12/2015
(Continued)

OTHER PUBLICATIONS

Fei Chen; Microstructural Modeling and numerical simulation of multi-physical fields for martensitic stainless steel during hot forging process of turbine fan; International J. of Advanced Manufacturing Technology (2016); 82:85-98 (Year: 2016).*
(Continued)

*Primary Examiner* — Alexandra M Moore
*Assistant Examiner* — Austin Pollock
(74) *Attorney, Agent, or Firm* — JCIPRNET

(57) ABSTRACT

In the method of producing a martensitic stainless steel strip, a quenching furnace of a quenching process includes at least a temperature raising unit and a holding unit. When a predetermined quenching temperature is set as T (° C.), the temperature raising unit is set to be within a temperature range of 0.7T (° C.) or higher and lower than T (° C.), and a set heating temperature on an exit side of the steel strip is set to be higher than a set heating temperature on an entry side of the steel strip when the steel strip passes through the temperature raising unit. The holding unit is set to the quenching temperature T (° C.). A time spent in the furnace by the steel strip in the temperature raising unit is equal to or longer than a time spent in the furnace by the steel strip in the holding unit.

4 Claims, 1 Drawing Sheet

(51) Int. Cl.

| | |
|---|---|
| ***C21D 1/74*** | (2006.01) |
| ***C22C 38/04*** | (2006.01) |
| ***C22C 38/02*** | (2006.01) |
| ***C21D 1/18*** | (2006.01) |
| ***C22C 38/22*** | (2006.01) |
| ***C21D 9/56*** | (2006.01) |
| ***C21D 1/25*** | (2006.01) |
| ***F27B 9/28*** | (2006.01) |
| ***C22C 38/18*** | (2006.01) |
| ***C21D 9/46*** | (2006.01) |
| ***F27B 9/12*** | (2006.01) |

(52) U.S. Cl.
CPC ..... *C21D 6/002* (2013.01); *C21D 6/005* (2013.01); *C21D 6/008* (2013.01); *C21D 9/56* (2013.01); *C22C 38/02* (2013.01); *C22C 38/04* (2013.01); *C22C 38/18* (2013.01); *C22C 38/22* (2013.01); *F27B 9/28* (2013.01); *C21D 9/46* (2013.01); *C21D 2211/008* (2013.01); *C21D 2241/00* (2013.01); *F27B 2009/122* (2013.01)

(58) Field of Classification Search
CPC ..... C21D 2211/008; C21D 2241/00; C21D 9/46; C21D 1/25; C21D 9/56; C21D 9/573; C21D 9/60; C22C 38/22; F27B 9/28; F27B 2009/122
See application file for complete search history.

(56) References Cited

FOREIGN PATENT DOCUMENTS

| | | |
|---|---|---|
| JP | S5149108 | 4/1976 |
| JP | S59133324 | 7/1984 |
| JP | 5534492 | 7/2014 |
| JP | 2015067873 | 4/2015 |

OTHER PUBLICATIONS

ASM Handook; "Heat Treating of Irons and Steels", vol. 4D, p. 383 & 385 (Year: 2014).*
Translation of JP2015-067873, Okada, 2015 (Year: 2015).*
"Search Report of European Counterpart Application," dated Apr. 18, 2018, pp. 1-5.
"Office Action of China Counterpart Application", dated Nov. 11, 2020, with English translation thereof, p. 1-p. 14.
Jon L. Dossett et al., "Heat Treating of Martensitic Stainless Steels," ASM Handbook: vol. 4D Heat Treating of Irons and Steels, Dec. 2014, pp. 1-5.

* cited by examiner

METHOD OF PRODUCING MARTENSITIC STAINLESS STEEL STRIP

CROSS-REFERENCE TO RELATED APPLICATIONS

This application claims the priority benefit of Japanese application serial no. 2017-003184, filed on Jan. 12, 2017. The entirety of the above-mentioned patent application is hereby incorporated by reference herein and made a part of this specification.

BACKGROUND

Technical Field

The disclosure relates to a method of producing a martensitic stainless steel strip.

Related Art

Martensitic stainless steel strips are excellent in corrosion resistance, hardness, and fatigue characteristics, and widely used for applications in, for example, cutting tools, spring materials to which stress is repeatedly applied, valve materials, and cover materials. Such martensitic stainless steel strips are generally produced by a method in which the strip is rolled to a predetermined plate thickness, and then the steel strip is continuously quenched and tempered while being unwound using a continuous heating facility in which a quenching furnace, a cooling device and a tempering furnace are continuously arranged in that order.

For example, Japanese Patent Application Laid-Open (JP-A) No. 2015-67873 describes a method of producing a martensitic stainless steel strip in which, before a quenching process, a preheating process in which preheating is performed on the steel strip using induction heating is performed, and thus the steel strip is rapidly heated, and a heat treatment capacity can be improved.

In order to deal with various applications, the above-described martensitic stainless steel strip needs to be thinned (for example, a plate thickness of 1 mm or less, and preferably 0.5 mm or less). However, due to the thinning, shape defects such as excessive medium elongation, edge waves, and waviness in the width direction are likely to occur.

The production method in JP-A No. 2015-67873 is an excellent invention through which it is possible to improve productivity by increasing a heat treatment capacity. However, problems and solutions regarding the occurrence of shape defects due to heating and prevention thereof are not mentioned and further studies remain.

Therefore, according to an embodiment of the disclosure, there is provided a method of producing a martensitic stainless steel strip through which it is possible to prevent shape defects without reducing productivity.

The inventors found that the occurrence of shape defects tends to increase due to a sudden change in temperature of a steel strip due to heating in a quenching furnace. Thus, the inventors conducted extensive studies regarding heating conditions during quenching. As a result, the inventors found that, when a heating pattern of the quenching furnace is controlled, it is possible to prevent shape defects of the steel strip during quenching, and completed the disclosure.

SUMMARY

That is, according to an embodiment of the disclosure, there is provided a method of producing a martensitic stainless steel strip by performing the following processes continuously: an unwinding process in which a martensitic stainless steel strip with a thickness 1 mm or less is unwound; a quenching process in which the steel strip is passed through a quenching furnace in a non-oxidizing gas atmosphere and heated and then cooled; a tempering process in which the quenched steel strip is passed through a tempering furnace in a non-oxidizing gas atmosphere and tempered; and a winding process in which the tempered steel strip is wound, wherein the quenching furnace of the quenching process includes at least a temperature raising unit and a holding unit, wherein, when a predetermined quenching temperature is set as T (° C.), the temperature raising unit is set to be within a temperature range of 0.7 T (° C.) or higher and lower than T (° C.), and a set heating temperature on an exit side of the steel strip is set to be higher than a set heating temperature on an entry side of the steel strip when the steel strip passes through the temperature raising unit, wherein the holding unit is set to a quenching temperature T (° C.), and wherein a time spent in the furnace by the steel strip in the temperature raising unit is equal to or longer than a time spent in the furnace by the steel strip in the holding unit.

According to one embodiment, when the time spent in the furnace by the steel strip in the temperature raising unit is set as TS and the time spent in the furnace by the steel strip in the holding unit is set as TH, TS/TH is greater than 1 and smaller than 5. According to one embodiment, in the quenching process, a temperature lowering unit configured to heat the steel strip at lower than a set heating temperature of the holding unit is provided after the holding unit.

According to one embodiment, a time required for the temperature lowering unit is 10 to 30% of a time M1 required for the steel strip to pass through the quenching furnace.

According to one embodiment, a set heating temperature of the temperature lowering unit is 0.85 T (° C.) or higher and lower than T (° C.).

According to one embodiment, when a plate thickness of the steel strip is set as t (mm) and a time for the steel strip to pass through the quenching furnace is set as M1 (min), M1/t is 4 or greater and 8 or less.

DESCRIPTION OF THE EMBODIMENTS

According to the disclosure, it is possible to obtain a martensitic stainless steel strip through which it is possible to prevent shape defects without reducing productivity.

The disclosure will be described below in detail. However, the disclosure is not limited to an embodiment described herein, and appropriate combinations and improvements can be made without departing from the spirit and scope of the invention. The disclosure may be applied to an object having a martensitic stainless steel composition. A composition range is not limited, but a component composition of a steel strip according to one embodiment of the disclosure includes, for example, C: 0.3 to 1.2%, and Cr: 10.0 to 18.0% in mass %. Further, the component composition of the steel strip according to one embodiment of the disclosure is a martensitic stainless steel including C: 0.3 to 1.2%, Si: 1% or less, Mn: 2% or less, Mo: 3.0% or less, Ni: 1.0% or less (including 0%), Cr: 10.0 to 18.0%, and the balance: Fe and inevitable impurities.

Figure 1:
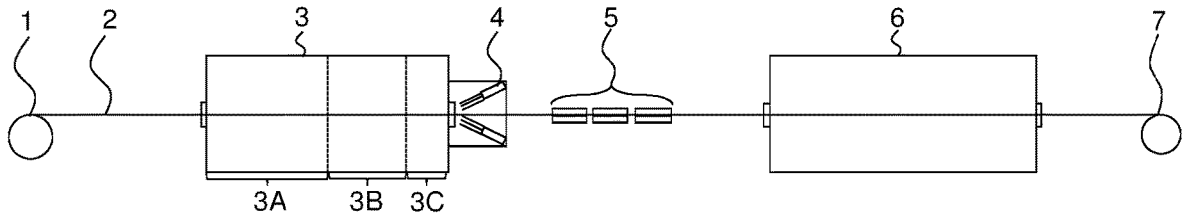
FIG. 1 is a diagram showing an example of a device used for a production method of the disclosure.

In the disclosure, an unwinding process, a quenching process, a tempering process, and a winding process are performed continuously, and the quenching process is performed in at least a temperature raising unit and a holding unit. In addition, a temperature lowering unit may be provided behind the holding unit. FIG. 1 shows a device layout example of the present embodiment. An embodiment of the disclosure will be described below.

(Unwinding Process and Quenching Process)

First, in the disclosure, in order to perform quenching and tempering continuously, a rolled steel strip 2 is unwound by an unwinding machine 1 (unwinding process), and then is passed through a heating furnace (quenching furnace) 3 in a non-oxidizing gas atmosphere and heated, and next the steel strip is cooled (quenching process). As shown in FIG. 1, the quenching furnace 3 used in the present embodiment includes a temperature raising unit 3A and a holding unit 3B. In the disclosure, before the holding unit configured to hold the steel strip that has passed through the furnace at a predetermined quenching temperature, the temperature raising unit configured to set a set heating temperature to be lower than a quenching temperature is provided. Here, in the temperature raising unit, a set heating temperature on the exit side of the steel strip is set to be higher than a set heating temperature on the entry side of the steel strip when the steel strip passes through the temperature raising unit. That is, in order to perform the quenching process in the disclosure, when a predetermined quenching temperature is set to T (° C.), in a temperature range of 0.7 T (° C.) or higher and less than T (° C.), the temperature raising unit configured to set a set heating temperature on the exit side of the steel strip to be higher than a set heating temperature on the entry side of the steel strip when the steel strip has passed through the temperature raising unit is provided and subsequently the holding unit set to the quenching temperature T (° C.) is provided. When heating in the quenching process is performed under the above condition, it is possible to prevent shape defects due to rapid heating without lowering a plate passing speed of the steel strip and it is possible to obtain a steel strip having a favorable shape. According to one embodiment, a lower limit of a set heating temperature is 0.8 T (° C.). When the set heating temperature of the temperature raising unit is lower than 0.7 T (° C.), the steel strip fails to rise to a desired temperature and characteristics may deteriorate. When the set heating temperature of the temperature raising unit is T (° C.) or higher, the steel strip is rapidly heated and shape defects are highly likely to occur. Here, in the present embodiment, when a time required for the steel strip to pass through the quenching furnace (in FIG. 1, a time for the steel strip to pass through the quenching furnace 3 (a time from when the steel strip enters the temperature raising unit 3A until it leaves a temperature lowering unit 3C)) is set as M1 [min], and a plate thickness of the steel strip is set as t [mm], M1/t is adjusted to 4 to 8. The above M1/t may be adjusted so that, for example, when the plate thickness is 0.3 mm, a time required for passing through quenching furnace is 1.2 to 2.4 min. When this numerical value is adjusted, it is possible to reliably obtain a shape control effect of the disclosure. Here, for example, in order to prevent a sudden change in the temperature, the set heating temperature of the temperature raising unit may be set so that the set heating temperature increases stepwise from the entry side of the steel strip to the exit side of the steel strip of the temperature raising unit. Here, the disclosure can be applied to a martensitic stainless steel strip with a plate thickness of 1 mm or less. However, as the thickness is smaller, shape defects are more likely to occur due to heating during quenching. Therefore, according to one embodiment, the disclosure can be applied to a martensitic stainless steel strip with a plate thickness of 0.5 mm or less. Here, there is no particular need to set a lower limit of the plate thickness. However, regarding a steel plate produced by, for example, rolling, since it is difficult to produce the steel strip when the plate thickness is too thin, the lower limit can be set to about 0.01 mm according to one embodiment. According to another embodiment, the lower limit of the plate thickness is 0.05 mm, and according to still another embodiment, the lower limit of the plate thickness is 0.1 mm.

In the present embodiment, a time spent in the furnace by the steel strip in the temperature raising unit is equal to or longer than a time spent in the furnace by the steel strip in the holding unit. Therefore, since it is possible to prevent the steel strip from being heated rapidly, it is possible to further prevent the occurrence of shape defects. When the time spent in the furnace by the steel strip in the temperature raising unit exceeds the time spent in the furnace by the steel strip in the holding unit by too much, there is a possibility of the steel strip not reaching a desired quenching temperature and desired characteristics not being obtained after quenching, and there is a possibility of more time being taken to reach a desired quenching temperature and productivity being reduced. When the time spent in the furnace by the steel strip in the temperature raising unit is shorter than the time spent in the furnace by the steel strip in the holding unit, since the holding unit becomes too long, there is a possibility of shape defects being caused due to overheating of the steel strip. Therefore, when the time spent in the furnace by the steel strip in the temperature raising unit is set as TS, and the time spent in the furnace by the steel strip in the holding unit is set as TH, TS/TH is greater than 1 and smaller than 5 according to another embodiment, and greater than 1.5 and smaller than 4 according to still another embodiment.

The set heating temperature in the holding unit in the present embodiment is 850 to 1200° C. When the set heating temperature is lower than 850° C., a carbide in a solid solution state is insufficient and characteristics deteriorate. On the other hand, when the set heating temperature exceeds 1200° C., an amount of carbide in a solid solution state increases and the hardness during tempering tends to decrease. The lower limit of the temperature of the holding unit is 900° C. according to another embodiment and 930° C. according to still another embodiment. The upper limit of the temperature of the holding unit is 1150° C. according to another embodiment and 1120° C. according to still another embodiment. In addition, regarding a type of a non-oxidizing gas, nitrogen, argon, a hydrogen mixed gas, and the like can be selected. However, according to one embodiment, argon that is unlikely to react with a martensitic stainless steel strip is selected.

In the present embodiment, the temperature lowering unit configured to heat the steel strip at a temperature lower than the set heating temperature of the holding unit may be provided after the holding unit. When the temperature lowering unit is provided, the temperature of the steel strip before cooling is lowered to some extent, and an effect of preventing a damage to a device in the subsequent cooling process can be expected. The set heating temperature of the temperature lowering unit is 0.85 T (° C.) or higher and lower than T (° C.) according to one embodiment, and 0.95

T (° C.) or lower with respect to the set heating temperature T (° C.) of the holding unit according to another embodiment. According to one embodiment, a time required is 10 to 30% of a time M1 required for the steel strip to pass through the quenching furnace.

The quenching furnace of the present embodiment can be constituted by a plurality of quenching furnaces, for example, two or more quenching furnaces. In this case, the temperature raising unit, the holding unit, and the temperature lowering unit may be set for each quenching furnace (discontinuous between furnaces), or the temperature raising unit may be set for one quenching furnace and the holding unit, and the temperature lowering unit may be set for one quenching furnace. According to one embodiment, the temperature raising unit and holding unit described above may be provided in one quenching furnace in order to save space and prevent a change in the temperature between furnaces. In addition, as a heat source of the quenching furnace of the present embodiment, a gas burner, an electric heater, or the like can be used.

In the disclosure, in order to further improve production efficiency, a preheating process may be performed between the unwinding process and the quenching process. In the preheating process (not shown), an existing heating device can be applied. However, according to one embodiment, an induction heating device that can raise the temperature of the steel strip rapidly is used.

In addition, in order to perform preheating effectively, a preheating temperature during the preheating process is set to 600° C. or higher according to one embodiment. On the other hand, in order to more reliably prevent deformation due to a sudden increase in the temperature, the temperature is set below 800° C. according to one embodiment.

Next, the steel strip heated in the quenching furnace is rapidly cooled and quenching is performed. As a rapid cooling method, there are methods using a salt bath, a molten metal, an oil, water, a polymer aqueous solution, or saline. Among them, a method of injecting water is the simplest method, and enables a thin oxide film to be formed on the surface of the steel strip. The thin oxide film is rigid, and when it passes through a water cooling surface plate 5 to be described below, the occurrence of cracks on the surface of the steel strip can be prevented. Therefore, according to one embodiment, the method of injecting water is used as a method of rapidly cooling the steel strip 2 used in the disclosure.

In addition, for rapid cooling in the quenching process, according to one embodiment, a first cooling process in which the steel strip 2 is cooled to 350° C. or lower below an Ms point by a spray device 4 using compressed air and clean water is performed and then a second cooling process in which the steel strip is restricted to be interposed between the water cooling surface plates 5 and is cooled to the Ms point or lower while the shape is corrected is performed, and thereby a martensite structure is obtained. The cooling is performed in two steps because it enables a perlite nose to be avoided in the first cooling process and distortion occurring when the steel strip 2 is quenched to be reduced, and also enables the shape of the steel strip 2 to be adjusted while martensite transformation is performed in the following second cooling process. A plurality of water cooling surface plates 5 used in the present embodiment are continuously arranged during cooling with water. Since this enables lengthening of the time spent restrained in the water cooling surface plate and more reliable cooling to the Ms point or lower, prevention of deformation of the steel strip 2 and correction can be expected to be performed more reliably.

(Tempering Process)

After the quenching process, the steel strip is tempered in a tempering furnace 6 in a non-oxidizing gas atmosphere, and the steel strip is adjusted to a desired hardness. The temperature of the tempering furnace can be set to a desired temperature according to applications. For example, when a higher hardness characteristic is necessary, the temperature can be set to 200 to 300° C. In addition, in order to improve shape processability such as press processing, the temperature can be set to 300° C. to 400° C. Here, when a plate passing speed is excessively high in the tempering process, there is a possibility of the above-described temperature range not being reached. Therefore, according to one embodiment, when a time required for the steel strip to pass through the tempering furnace is set as M2 [min], and the plate thickness of the steel strip is set as t [mm], M2/t is set to 5 to 9.

(Winding Process)

After the tempering process, when the steel strip is wound by a winding machine 7, it is possible to obtain a martensitic stainless steel strip having a desired hardness without causing decarburization.

In the disclosure, as described above, in the processes from the unwinding process to the winding process, the steel strip unwound from a coil is wound around a coil again, which can be performed continuously. Therefore, the productivity is high.

Examples

First, three types of martensitic stainless steel strips with widths of about 300 mm and thicknesses of 0.15 mm, 0.25 mm, and 0.35 mm were prepared. The compositions are shown in Table 1. The prepared steel strips were set in the unwinding machine 1, the steel strips were unwound by the unwinding machine, and the unwound steel strips were passed through the quenching furnace in an argon gas atmosphere. The quenching furnace included the temperature raising unit 3A, the holding unit 3B, and the temperature lowering unit 3C. The set heating temperature of the temperature raising unit 3A was set to a temperature of the holding unit or lower and to be in a range of 800° C. to 1040° C. so that the set heating temperature gradually increased toward the holding unit. The temperature of the holding unit 3B was set to 1040 to 1100° C., and the temperature of the temperature lowering unit 3C was set to 950 to 1040° C. Here, as an example of the set heating temperature, the temperature raising unit 3A set three steps (800 to 890° C., 900 to 970° C., and 980 to 1030° C.) of the set heating temperature from the entry side to the exit side of the temperature raising unit. Plate passing speeds of the steel strips were adjusted so that M1/t became about 6 when a time required for the steel strip to pass through the quenching furnace (a time from when the steel strip enters the temperature raising unit 3A of the quenching furnace 3 until it leaves the temperature lowering unit 3C) was set as M1 [min], and the plate thickness of the steel strip was set as t [mm]. Next, pure water was sprayed on the steel strip by the cooling water spray device 4 installed on the exit side of the quenching furnace to perform primary cooling, the steel strip was cooled to 290 to 350° C., and then a secondary cooling process in which the steel strip was pressed by the water cooling surface plate 5 was performed, and the steel strip was cooled to 100° C. or lower. Then, the plate passing speed of the steel strip was adjusted so that M2/t became about 7 when a time required for the steel strip to pass through the tempering furnace was set as M2 [min], and the plate thickness of the steel strip was set as t [mm] and the steel strip was passed through the tempering furnace 6 in an argon gas atmosphere. The temperature of the tempering furnace was set to 250 to 300° C., and tempering was performed. The steel strip was wound by the winding machine 7 to prepare a martensitic stainless steel strip of the present example. Here, in the present example, when a time M1 required for the steel strip to pass through the quenching furnace was defined as 100%, the plate passing speed was adjusted so that a time required for the temperature raising unit was 50%, a time required for the holding unit was 34%, and a time required for the temperature lowering unit was 16%. On the other hand, in martensitic stainless steel strips of comparative examples, all heating during the quenching process was performed in the holding unit, and the set heating temperature was 1040 to 1100° C.

TABLE 1

| C | Si | Mn | Cr | Mo | Balance (Mass %) |
|---|---|---|---|---|---|
| 0.39 | 0.3 | 1.23 | 13.17 | 1.23 | Fe and inevitable impurities |

Figure 2:
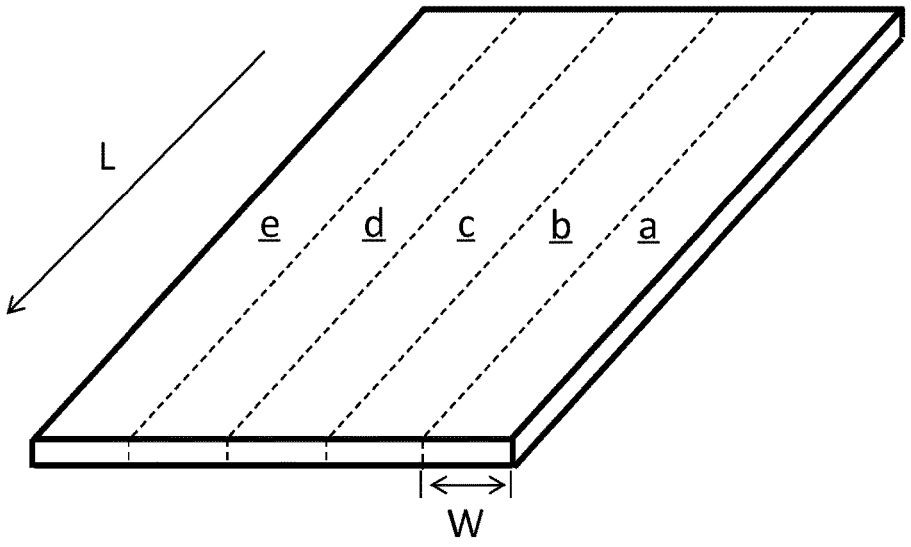
FIG. 2 is a diagram for explaining a position of a metal strip with respect to a steel strip in the present example.

Next, flatnesses of the present examples and comparative examples were measured. A method of measuring a flatness is described below. The martensitic stainless steel strip obtained in the processes described above was cut to 400 mm in the length direction (the L direction in FIG. 2) and 60 mm in the width direction (the W direction in FIG. 2) to obtain five sections of the measurement samples (length of 400 mm×width of 60 mm). Then, the obtained measurement sample was placed on a horizontal surface plate, and amounts of lifting in the width direction were measured at five points randomly using a dial gauge. Next, a maximum value among the obtained amounts of lifting at the five points was divided by the width of the measurement sample, and the obtained value was obtained as the flatness of the present example. The results are shown in Table 2. Based on Table 2, it was confirmed that the present examples at all thicknesses of 0.15 mm, 0.25 mm, and 0.35 mm had more favorable flatness than the comparative examples.

TABLE 2

| Samples | Plate thickness (mm) | Flatness [%] Section a | Section b | Section c | Section d | Section e | Average |
|---|---|---|---|---|---|---|---|
| Present Example 1 | 0.15 | 0.08 | 0.12 | 0.05 | 0.07 | 0.13 | 0.09 |
| Comparative Example 1 | | 0.20 | 0.26 | 0.26 | 0.22 | 0.20 | 0.23 |
| Present Example 2 | 0.25 | 0.09 | 0.04 | 0.07 | 0.07 | 0.05 | 0.06 |
| Comparative Example 2 | | 0.17 | 0.14 | 0.20 | 0.18 | 0.16 | 0.17 |
| Present Example 3 | 0.30 | 0.07 | 0.03 | 0.06 | 0.04 | 0.07 | 0.05 |
| Comparative Example 3 | | 0.11 | 0.15 | 0.13 | 0.18 | 0.14 | 0.14 |

What is claimed is:

1. A method of producing a martensitic stainless steel strip by performing the following processes continuously:

an unwinding process in which a stainless steel strip with a thickness of 1 mm or less is unwound;

a quenching process in which the steel strip is passed through a quenching furnace in a non-oxidizing gas atmosphere and heated and then cooled;

a tempering process in which the quenched steel strip is passed through a tempering furnace in a non-oxidizing gas atmosphere and tempered; and a winding process in which the tempered steel strip is wound, wherein the quenching furnace of the quenching process comprises at least a temperature raising unit, a holding unit, and a temperature lowering unit, wherein, when a predetermined heating temperature is set as T (° C.), the temperature raising unit is set to be within a temperature range of 0.7T (° C.) or higher and lower than T (° C.), and a set heating temperature on an exit side of the steel strip is set to be higher than a set heating temperature on an entry side of the steel strip when the steel strip passes through the temperature raising unit, wherein the holding unit is set to the predetermined heating temperature T (° C.), wherein the temperature lowering unit is provided after the holding unit, and a set heating temperature of the temperature lowering unit for heating the steel strip is 0.85T (° C.) or higher and lower than T (° C.), and wherein a time spent in the quenching furnace by the steel strip in the temperature raising unit is equal to or longer than a time spent in the quenching furnace by the steel strip in the holding unit.

2. The method of producing a stainless steel strip according to claim 1, wherein, when the time spent in the quenching furnace by the steel strip in the temperature raising unit is set as TS and the time spent in the quenching furnace by the steel strip in the holding unit is set as TH, TS/TH is greater than 1 and smaller than 5.

3. The method of producing a stainless steel strip according to claim 1, wherein a time required for the temperature lowering unit is 10 to 30% of a time M1 required for the steel strip to pass through the quenching furnace.

4. The method of producing a stainless steel strip according to claim 1, wherein, when a plate thickness of the steel strip is set as t (mm) and a time for the steel strip to pass through the quenching furnace is set as M1 (min), M1/t is 4 or greater and 8 or less.

* * * * *